US006939589B2

(12) United States Patent
Chung

(10) Patent No.: US 6,939,589 B2
(45) Date of Patent: Sep. 6, 2005

(54) TRANSFER PAPER BY HEAT ABLE TO DISSOLVE A METAL LAYER PARTIALLY AND THE PREPARATION METHOD THEREOF

(75) Inventor: Sook Hee Chung, Suwon-Si (KR)

(73) Assignee: Korea Chemical Co., Ltd. (KR)

( * ) Notice: Subject to any disclaimer, the term of this patent is extended or adjusted under 35 U.S.C. 154(b) by 216 days.

(21) Appl. No.: 10/371,805

(22) Filed: Feb. 21, 2003

(65) Prior Publication Data

US 2004/0105977 A1 Jun. 3, 2004

(51) Int. Cl.[7] ..... B41M 5/40

(52) U.S. Cl. ..... 428/32.79; 427/152; 428/32.81; 428/209

(58) Field of Search ..... 427/152; 428/32.77, 428/32.78, 32.79, 32.8, 32.81, 209

(56) References Cited

U.S. PATENT DOCUMENTS 6,428,877 B1 * 8/2002 Suss et al. ..... 428/32.76

* cited by examiner

*Primary Examiner*—Bruce H. Hess
(74) *Attorney, Agent, or Firm*—F. Chau & Associates LLC

(57) ABSTRACT

Disclosed is a thermal transfer paper comprising a metal layer and capable of partially dissolving the metal layer, which comprises a dissolving function formed of at least one resin selected from the group consisting emulsion resins, water-soluble acryl resins, water-soluble polybutyral resins, alcohol-soluble polybutyral resins, water-soluble vinyl resins and alcohol-soluble vinyl resins, water or an alcohol solvent, and sodium hydroxide or an acid on the metal layer. The thermal transfer paper according to the present invention is provided with a dissolving function layer 30 able to dissolve a part of a metal layer 20, preferably an aluminum deposition layer 21 to form a dissolved part according to a desired design or pattern. Therefore, it is possible to produce unique color and texture, unlike a metal layer pattern formed by oxidation of a part on the metal layer. Specially, when a different color is transferred on a transfer object by an ink layer formed on the transfer paper, it is harmonized with a background color of the transfer object to produce a partial metal-like effect. Thus, according to the present invention, a design with superior texture and color can be readily formed in various patterns, thereby accomplishing a speedy, simple and thereby efficient working process for production and cost saving effect.

21 Claims, 10 Drawing Sheets

TRANSFER PAPER BY HEAT ABLE TO DISSOLVE A METAL LAYER PARTIALLY AND THE PREPARATION METHOD THEREOF

FIELD OF THE INVENTION

The present invention relates to a thermal transfer paper capable of partially dissolving a metal layer 20 and a method for preparing the same, and more particularly to a thermal transfer paper capable of partially dissolving a metal layer 20, preferably a desired part of an aluminum deposition layer 21 according to a desired design or pattern to provide an article upon which superior texture and color is produced and a method for preparing the same.

For the purpose of the present invention, the expression "on a given layer formed on a base film" used herein refers to a side away from the base film, based on the given layer, that is, the upper side, when the base film is considered as the bottom layer and the expression "under a given layer formed on a base film" used herein refers to a side close to the base film, that is, the lower side.

For the purpose of the present invention, "an ink" used herein refers to any ink commonly used in the art, comprising a resin, a pigment (or a dye) and a solvent, as long as any other composition is not specified.

For the purpose of the present invention, "a transparent color ink" used herein refers to an ink with a particularly specified composition.

For the purpose of the present invention, "a pigment" used herein refers to any pigment commonly used for the gravure ink.

For the purpose of the present invention, an ink layer 12 and a print ink layer 32 is distinguished by a word "print" so that the composition of the ink layer 12 is not particularly specified to serve a special function.

BACKGROUND OF THE RELATED ART

In general, when a picture frame, furniture, or decorative material for construction interior is manufactured using wood or synthetic molding material, various 3-dimensional patterns are provided on the frame by an outer surface treatment for the esthetic sense.

For this purpose, the outer surface of the frame is applied with paint at least once, followed by drying. The treated surface is then dissolved to express a predetermined 3-dimensional pattern for realization of various designs.

Thus, as an example, the outer surface of a frame is applied with a base color and then a different color, followed by drying. Then, an aluminum foil is attached to parts of the surface and the surface is partially dissolved to produce a 3-dimensional pattern.

However, such applying process and particularly, partial dissolving process for formation of various 3-dimensional patterns should be manually carried out by an operator on the outer surface of a frame. Therefore, there are many problems in that the operator may make a mistake during the operation and when a mistake is made, the frame should be dumped, in other words, the process is complex and cumbersome. Also, an excessive process time and cost are required and the process efficiency is low. Therefore, it is impossible to achieve a speedy mass production and is also difficult to produce various patterns due to the difficulties in the process.

In order to solve these problems, there has been known a method for producing a 3-dimensional pattern by directly thermal-transferring a transfer film on a transfer object such as a picture frame by heat and pressure of a synthetic roller.

Meanwhile, in order to realize a unique color and texture with a bronze-like or rusted metal-like effect as well as a metal-like effect on a transfer object such as a picture frame, there has been known a method, in which a gold or silver foil of aluminum monomer is transferred on the transfer object, an erosion solution is applied on a desired part of the transfer object with the gold or silver foil attached, whereby the part where the erosion solution has not been applied shows the gold and silver foil effect while the part where the erosion solution has been applied shows natural color sense and texture such as a dark red color of rusted iron or a bronze color of rusted copper with a certain patterns.

However, since such conventional techniques use gold and silver foil of aluminum monomer and involve the direct application of an erosion solution on a transfer object, close attention should be paid during the production process, and hence an excessive process time and cost are taken. Therefore, they only can be limitedly applied for special products and have a non-effectiveness in the process due to the direct application. Further, they have a limitation in providing various patterns.

Therefore, there are demands for a technique for improving variety of pattern and efficiency of process in realization of natural color and texture with a metal-like effect and rusted metal-like effect.

SUMMARY OF THE INVENTION

Thus, the present invention has been made in view of the above problems, and it is an object of the present invention to provide a thermal transfer paper capable of partially dissolving a metal layer 20 comprising an ink layer 30 able to partially dissolve the metal layer 20, preferably a desired part of an aluminum deposition layer 21 according to a desired design or pattern so that a metal-like effect, particularly a rusted metal-like natural color and texture effect can be readily produced, the process efficiency can be improved by a reduction of processing time and manufacturing cost and various 3-dimensional pattern can be readily created, and a method for preparing the same.

The above object of the present invention can be achieved by a thermal transfer paper capable of partially dissolving a metal layer comprising a metal layer 20; and a dissolving function layer 30 disposed on the metal layer 20 and formed of a resin comprising at least one selected from the group consisting of emulsion resins, water-soluble acryl resins, water-soluble polybutyral resins, alcohol-soluble polybutyral resins, water-soluble vinyl resins and alcohol-soluble vinyl resins, water or an alcohol solvent, and sodium hydroxide or an acid.

The metal layer is preferably an aluminum deposition layer 21. More preferably, a transparent color ink layer 13 is provided under the aluminum deposition layer 21.

Also, the above object of the present invention can be achieved by a method for manufacturing a thermal transfer paper capable of partially dissolving a metal layer 20 comprising the steps of: depositing a metal layer 20 on a base film 10 or a deposited layer (not shown) formed on the base film 10 (S1); and dissolving a resin comprising at least one selected from the group consisting of emulsion resins, water-soluble acryl resins, water-soluble polybutyral resins, alcohol-soluble polybutyral resins, water-soluble vinyl resins and alcohol-soluble vinyl resins in water or an alcohol solvent, adding sodium hydroxide or an acid and applying the resulting solution on the deposited metal layer 20 to form a dissolving function layer 30 (S2).

The step (S1) may be preferably carried out by vacuum deposition of aluminum and more preferably, a transparent color ink layer 13 having a transparent color is formed under an aluminum deposition layer 21.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Now, the thermal transfer paper capable of partially dissolving a metal layer and a method for producing the same according to the present invention will be described hereinafter in detail with reference to the accompanying drawings.

The thermal transfer paper capable of partially dissolving a metal layer and a method for producing the same according to the present invention are based on the layer structure of the thermal transfer paper comprising a metal layer 20 and a dissolving function layer 30 formed on the metal layer 20 to dissolve the metal layer 20.

For the dissolving function, the dissolving function layer 30 is formed by dissolving a resin containing at least one selected from the group consisting of emulsion resins, water-soluble acryl resins, water-soluble polybutyral resins, alcohol-soluble polybutyral resins, water-soluble vinyl resins and alcohol-soluble vinyl resins in water or an alcohol solvent, followed by addition of sodium hydroxide or an acid. However, it is appreciated by those skilled in the art that other resins may be further added to the dissolving function layer 30 without departing the scope of the invention.

Figure 1:
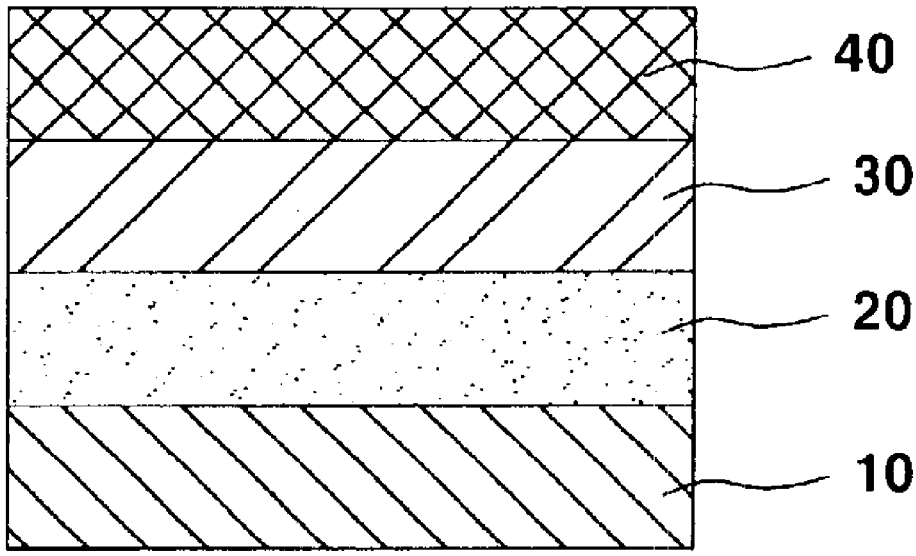
FIG. 1 is a schematic sectional view showing the layer structure of the thermal transfer paper according to the present invention comprising a base film, a metal layer, a dissolving function layer and an adhesive layer.
Figure 2:
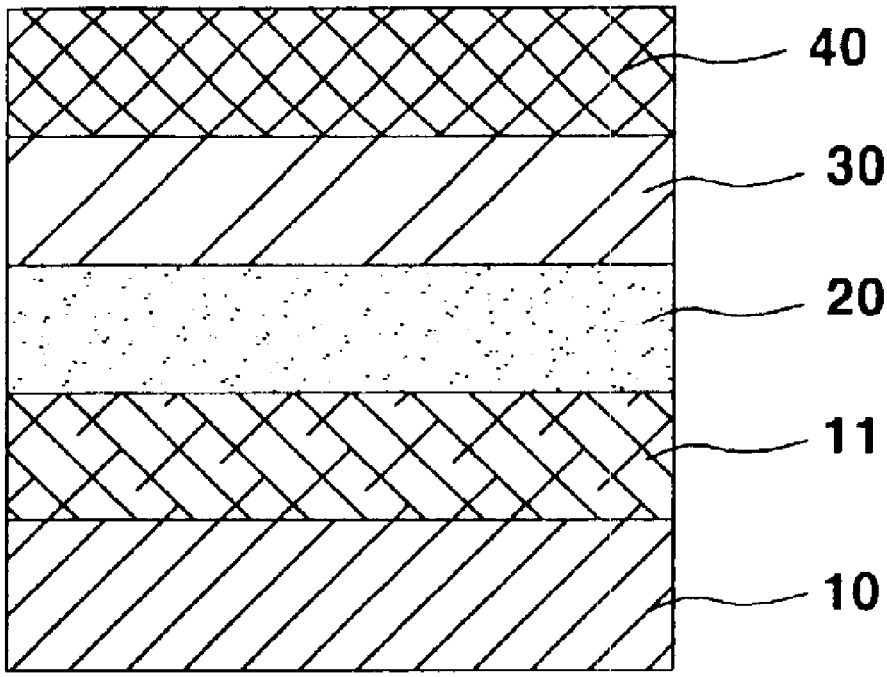
FIG. 2 is a schematic sectional view showing the layer structure of the thermal transfer paper according to the present invention further comprising a release layer in addition to the structure of the thermal transfer paper of FIG. 1.
Figure 3:
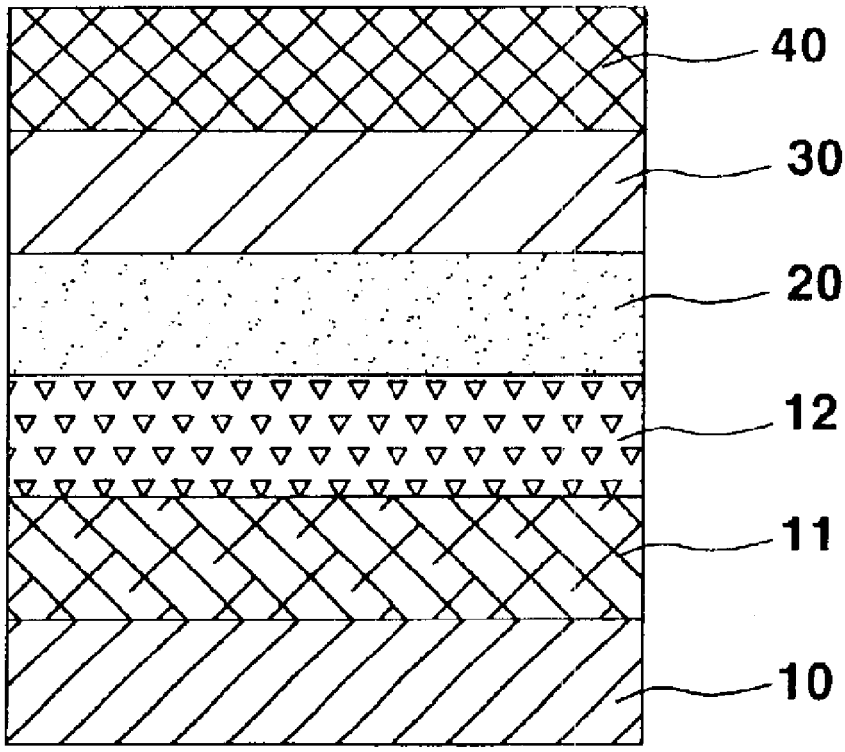
FIG. 3 is a schematic sectional view showing the layer structure of the thermal transfer paper according to the present invention further comprising an ink layer in addition to the structure of the thermal transfer paper of FIG. 2.
Figure 4:
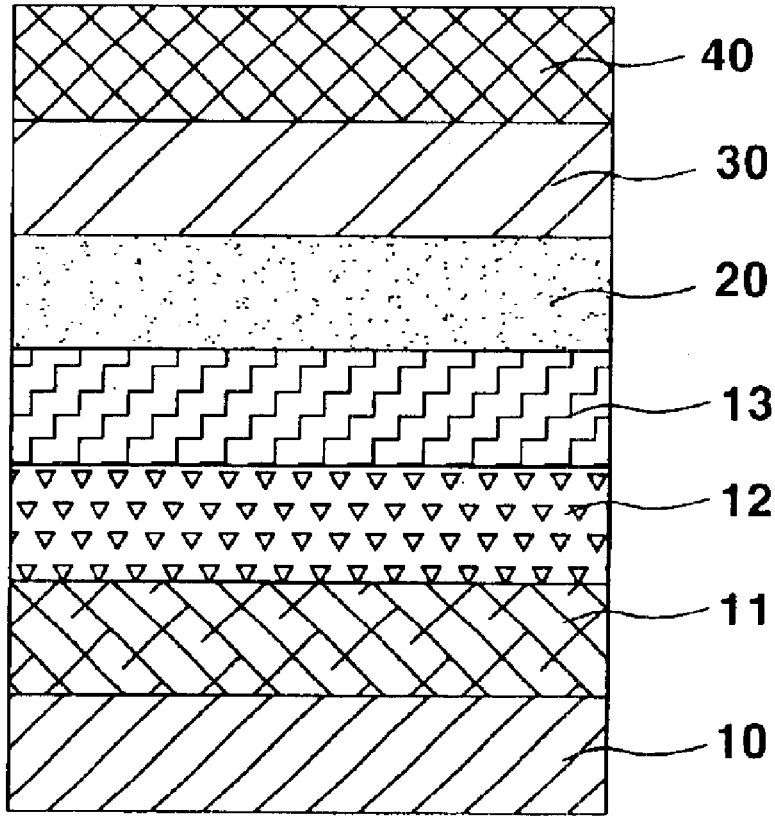
FIG. 4 is a schematic sectional view showing the layer structure of the thermal transfer paper according to the present invention further comprising a transparent color ink layer in addition to the construction of the thermal transfer paper of FIG. 3.
Figure 5:
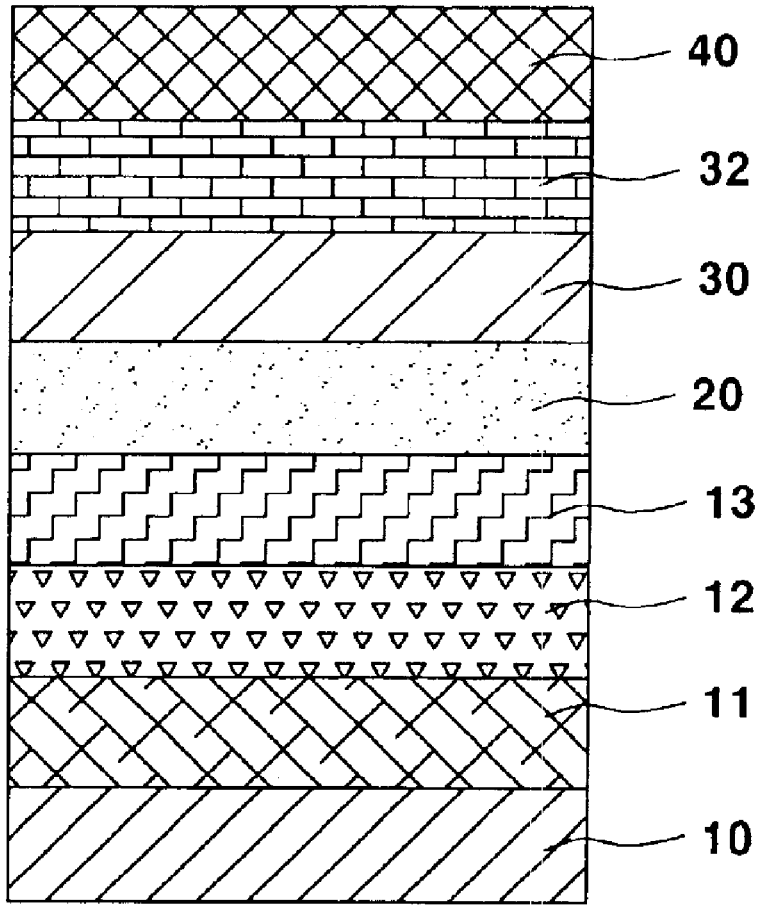
FIG. 5 is a schematic sectional view showing the layer structure of the thermal transfer paper according to the present invention further comprising a print ink layer in addition to the construction of the thermal transfer paper of FIG. 4.
Figure 6:
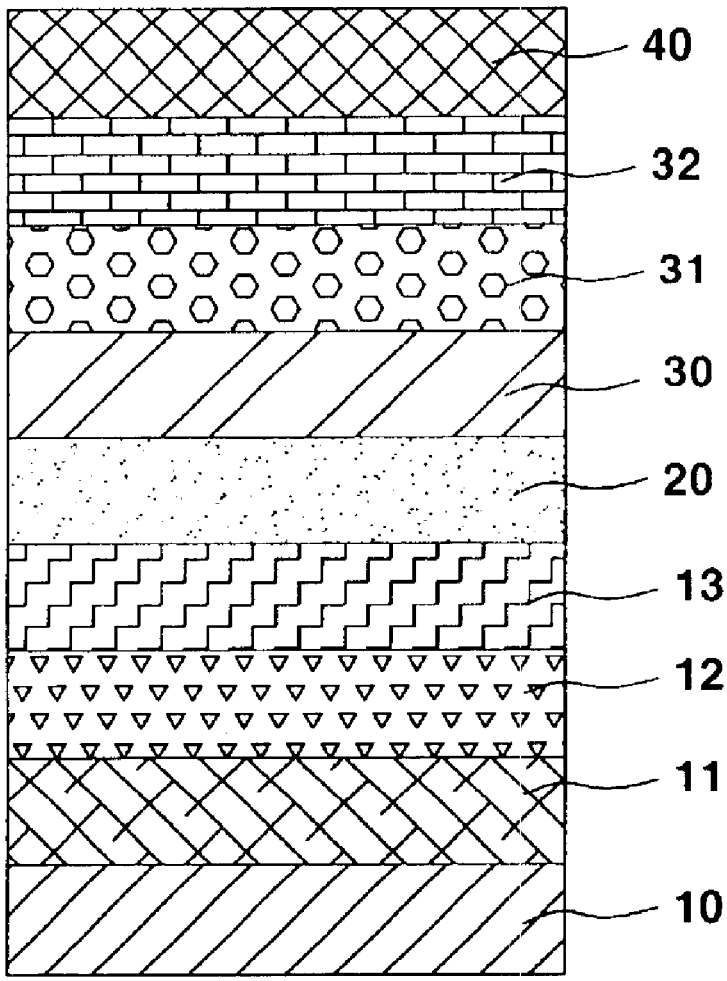
FIG. 6 is a schematic sectional view showing the layer structure of the thermal transfer paper according to the present invention further comprising a primer layer in addition to the construction of the thermal transfer paper of FIG. 5.

FIG. 1 shows the layer structure of the thermal transfer paper according to the present invention comprising a base film 10, a metal layer 20, a dissolving function layer 30 and an adhesive layer 40, FIG. 2 shows the layer structure of the thermal transfer paper according to the present invention further comprising a release layer 11 in addition to the structure of the thermal transfer paper of FIG. 1, FIG. 3 shows the layer structure of the thermal transfer paper according to the present invention further comprising an ink layer 12 in addition to the structure of the thermal transfer paper of FIG. 2, FIG. 4 shows the layer structure of the thermal transfer paper according to the present invention further comprising a transparent color ink layer 13 in addition to the construction of the thermal transfer paper of FIG. 3, FIG. 5 shows the layer structure of the thermal transfer paper according to the present invention further comprising a print ink layer 32 in addition to the construction of the thermal transfer paper of FIG. 4, and FIG. 6 shows the layer structure of the thermal transfer paper according to the present invention further comprising a primer layer 31 in addition to the construction of the thermal transfer paper of FIG. 5.

The thermal transfer paper capable of partially dissolving a metal layer according to the present invention has a simple structure which comprises a base film 10, a metal layer 20, a dissolving function layer 30 and an adhesive layer 40, laminated in this order, and preferably comprises a base film 10, a transparent color ink layer 13, an aluminum deposition layer 21, a dissolving function layer 30 and an adhesive layer 40, laminated in this order.

As shown in FIGS. 1 to 6, the thermal transfer paper according to the present invention may further comprise at least one of a release layer 11, an ink layer 12, a transparent color ink layer 13, a print ink layer 32 and a primer layer 31. When the aluminum deposition layer 21 has been already formed by vacuum deposition of aluminum, the transparent color ink layer 13 is disposed under the aluminum deposition layer 21.

Here, the release layer 11 may be further disposed on the base film 10. The ink layer 12 may be further disposed on the base film 10, or on the release layer 11 when the release layer 11 is formed on the base film 10. The transparent color ink layer 13 may be further disposed on the base film 10, on the release layer 11 when the release layer 11 is formed, or on the ink layer 12 when the ink layer is formed. The primer layer 31 may be further disposed on the dissolving function layer 30. The print ink layer 32 may be further disposed on the dissolving function layer 30 or on the primer layer 32 when the primer layer 31 is formed on the dissolving function layer 30.

The base film 10 comprises at least one selected from the group consisting of transparent or mat polyester (PET) films, polypropylene (PP) films and polyvinyl chloride (PVC) films and may further comprise a matifying agent coated on the above listed films. Preferably, a PET-mat film having a semi-gloss effect is used. The base film preferably has a thickness of 12 to 25 $\mu$m.

The release layer 11 is generally provided for strippability and releasability except for a special product, though it may be omitted according to a design or layer structure of a product. The release layer 11 may be formed to further have an ability to be removed by washing with water or an alcohol solvent after the transfer process, when necessary. Also, it may function as an ink by addition of a pigment at the same time.

Thus, examples of release agents which can be used in the release layer include resins containing at least one selected from the group consisting of acryl resins, polyester resins, emulsion resins, water-soluble or alcohol-soluble polybutyral reins, water-soluble or alcohol-soluble vinyl reins and nitro cellulose resins. The solvent for dissolving the release agent includes at least one selected from the group consisting of water, alcohols, for example isopropyl alcohol, ketone solvents, for example methylethyl ketone, acetate solvents, for example ethyl acetate, aromatic solvents, for example toluene, and a mixture of any two or more thereof. In addition, a pigment and other additives such as a dispersant, anti-precipitation agent, anti-static agent, and the like may be used.

In a preferred embodiment, the release layer 11 may be formed by dissolving a acryl resin, for example a acryl resin or polyester reins, alone or in combination, in a ketone solvent, acetate solvent or aromatic solvent, or a mixture of any two or more thereof.

In another preferred embodiment, the release layer 11 is formed by dissolving an emulsion resin or water-soluble acryl resin, alone or in combination, in a mixture of water, an alcohol solvent, a pigment and an additive.

In yet another preferred embodiment, the release layer 11 is formed by dissolving a vinyl resin and water-soluble or alcohol-soluble polyvinylbutyral resin in a mixture of water, an alcohol solvent, a ketone solvent, an acetate solvent, an aromatic solvent, a pigment and an additive.

The ink layer 12 may be omitted according to a design or layer structure of a product.

Preferably, the ink layer 12 may be formed to function as an release agent when the release layer 11 is not formed and also to have an ability to be removed by washing with water or an alcohol solvent after the transfer process, thereby exhibiting an antiquated style. In this case, the release layer 11 is not provided and the ink layer 12 is formed by an ink comprising particularly a resin which is soluble in water or an alcohol.

The ink layer 12 is formed of a resin, a pigment and a solvent. In a preferred embodiment, the ink layer 12 may be formed by dissolving a resin comprising at least one selected from the group consisting of acryl resins, vinyl resins, nitro cellulose reins, polyamide resins and polybutyral resins, and a pigment in one selected from ketone solvents, for example methylethyl ketone, acetate solvents, for example ethyl acetate, aromatic solvents, for example toluene, water, alcohols, for example isopropyl alcohol, or a mixture of any two or more thereof. In addition, a small amount of other additives such as a dispersant, anti-precipitation agent, anti-static agent, and the like may be used.

In a more preferred embodiment, the ink layer 12 is formed by mixing an acryl resin, vinyl resin, nitro cellulose rein, polyamide resin or polybutyral resin with a ketone solvent, acetate solvent, aromatic solvent or alcohol solvent and a pigment.

The metal layer 20 is formed by depositing metal in the form of a film for realizing a metal-like effect on a transfer object.

Prior to formation of the metal layer 20, a transparent color ink layer 13 may be formed. The metal layer is preferably an aluminum deposition layer formed by deposition of aluminum in terms of economical efficiency, in which the transparent color ink layer 13 should be formed.

The aluminum deposition layer 21 is formed by vacuum depositing aluminum preferably to a layer thickness of about 150 to 200 Å.

The transparent color ink layer 13 is formed of a general ink comprising a resin, a dye and a solvent, particularly an ink having a transparent color to produce a gold or silver foil paper. In a preferred embodiment, the transparent color ink layer 13 is formed by dissolving a dap resin with excellent heat resistance, nitro cellulose resin, acryl resin, acryl urethane resin, nitro cellulose resin or vinyl resin alone, or a mixture of any two or more thereof and a pigment in one selected from ketone solvents, for example methylethyl ketone, acetate solvents, for example ethyl acetate, aromatic solvents, for example toluene, alcohols, for example isopropyl alcohol, or a mixture of any two or more thereof. Also, a curing agent, preferably TDI type curing agent can be used. A dye is used in an amount of 5% by weight based on 100% by weight of the transparent color ink. In addition, in order to control the solubility of the metal layer 20, preferably the aluminum deposition layer 21, a pearl pigment, a matifying agent, an inorganic pigment, and the like may be used.

The dissolving function layer 30 to partially dissolve the deposited surface of the metal layer 20, preferably the aluminum deposition layer 21 is formed by dissolving a resin comprising an emulsion resin, a water-soluble acryl resin, a water-soluble butyral resin, an alcohol-soluble butyral resin, a water-soluble vinyl resin, an alcohol-soluble vinyl resin alone or a mixture of any two or more thereof in water or an alcohol solvent, followed by addition of sodium hydroxide or an acid.

Figure 8:
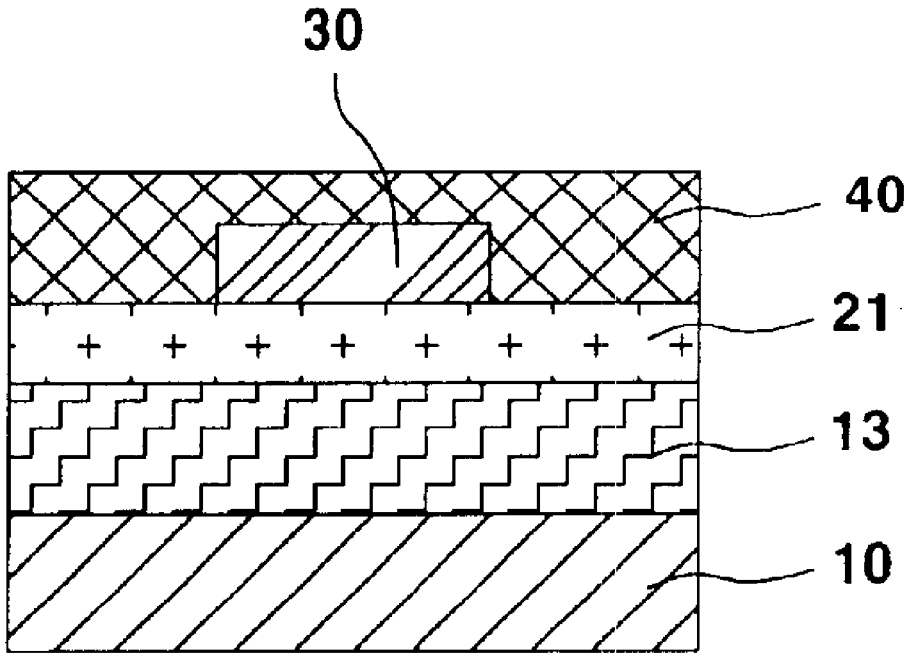
FIG. 8 is a schematic sectional view showing the layer structure of the thermal transfer paper according to the present invention, in which the dissolving function layer is partially formed.
Figure 9:
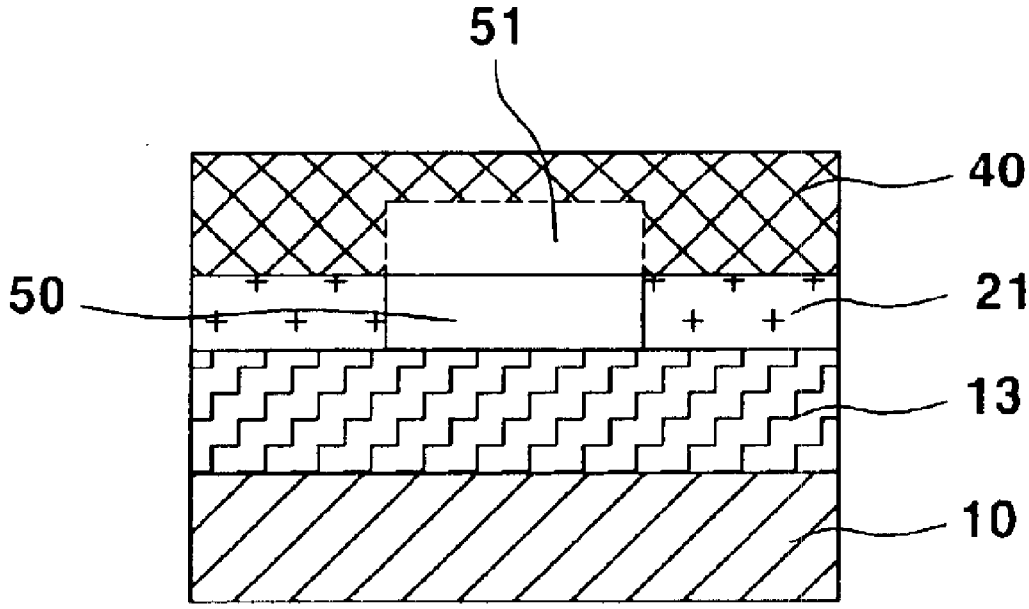
FIG. 9 is a schematic sectional view showing the layer structure of the thermal transfer paper according to the present invention after the dissolving function layer have partially dissolved the aluminum deposition layer.
Figure 10:
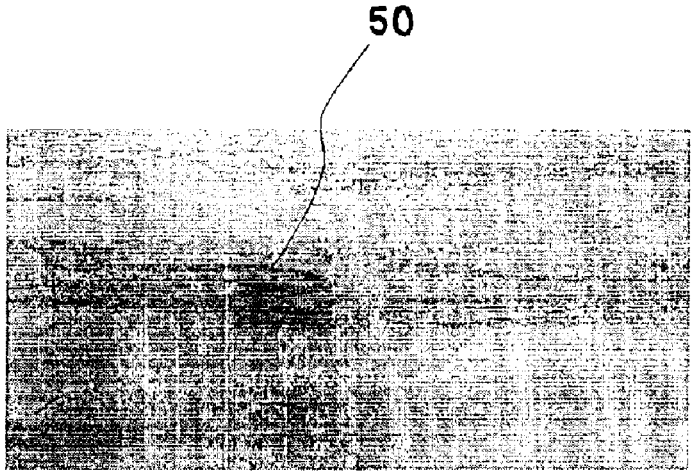
FIG. 10 is a photograph showing the dissolving function layer partially formed on the aluminum deposition layer formed on the base film.

FIG. 8 is a schematic sectional view showing the layer structure of the thermal transfer paper according to the present invention, in which the dissolving function layer is partially formed, FIG. 10 is a photograph showing the dissolving function layer formed in part on the aluminum deposition layer and FIG. 9 is a schematic sectional view showing the layer structure of the thermal transfer paper according to the present invention after the dissolving function layer have been partially dissolved the aluminum deposition layer.

As shown in FIGS. 8 and 10, the dissolving function layer 30 is formed in part on the aluminum deposition layer 21 to produce a desired pattern. Then, as shown in FIG. 9, the dissolving function layer 30 partially dissolves the deposited surface of the aluminum deposition layer 21 to form a dissolved part 50, upon which the dissolving function layer 30 is removed to form a disappearance part 51.

Figure 11:
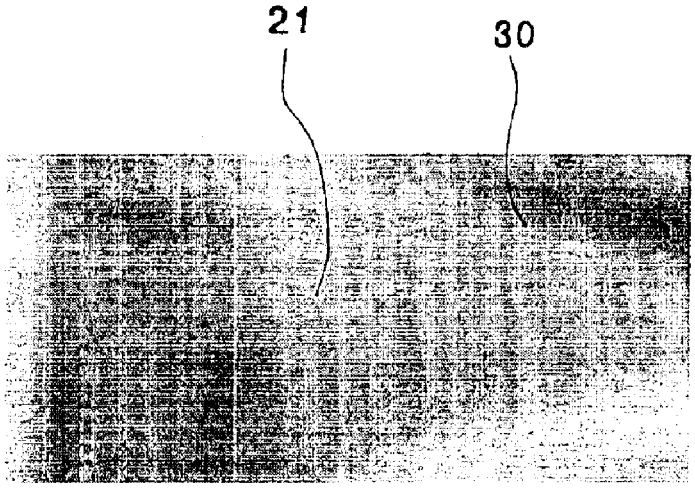
FIG. 11 is a photograph showing the pattern in which the aluminum deposition layer is partially dissolved after the thermal transfer paper is transferred on a transfer object.

FIG. 11 is a photograph showing the pattern in which the aluminum deposition layer is partially dissolved after the thermal transfer paper has been transferred on a transfer object.

As shown in FIG. 11, through the dissolved part 50 a layer deposited under the aluminum deposition layer 21 becomes visible, thereby producing a pattern with unique texture and color.

In a preferred embodiment, the primer layer 31 is formed by dissolving an acryl resin, for example methylmethacrylate resin and vinyl resin in a ketone solvent, acetate solvent, toluene solvent or a mixture of two or more thereof. More preferably, a maleic acid resin may be added to the resin mixture.

The primer layer 31 may be omitted but where, it is formed, provides a good interlayer adhesion, thereby improving printing efficiency.

In an additional process, a print ink layer 32 may formed. Where it is provided, as shown in FIG. 11, it is dissolved by the dissolving function layer 30, upon which the ink contained therein is injected in the dissolved part 50. As a result, it is possible to obtain an effect like showing a background color in transfer.

The print ink layer 32 has the same composition as the ink layer 12. Preferably, it is formed by dissolving an acryl resin or vinyl resin in a ketone solvent, acetate solvent or aromatic solvent alone, or a mixture of two or more thereof, followed by addition of a pigment. More preferably, a small amount of an additive such as a dispersant, anti-precipitation agent, anti-static agent, and the like may be added to the composition.

The adhesive layer 40 comprises mainly an acryl resin and a vinyl resin may be added. The adhesive layer 40 is preferably comprises 28% by weight of an acryl resin, 5% by weight of a vinyl resin and 67% by weight of a solvent. Examples of the useful solvents include methylethyl ketone, toluene or ethyl acetate alone, or a mixture of two or more thereof. If necessary, a pigment or a dye can be added.

The adhesion is preferably accomplished by pressing the transfer layer with a pressure roller at a temperature of about 130° C. and a rate of about 3 to 5 m/min, however, it is not limited thereto. The adhesive layer 40 is uniformly coated on the layer which already has been deposited by means of a maybar or a cylinder for coating.

According to the present invention, lamination of a layer on the base film is performed as many as needed without limit. For example, for the ink layer 12, a plurality of layers is needed to form a color pattern and such construction is included in the scope of the invention, though an embodiment having one ink layer 12 is provided in the description. Thus, it should be appreciated by those skilled in the art that an embodiment having an additional layer is included in the scope of the present invention, as long as it comprise the construction according to the present invention as described above.

Now, the present invention will be described in further detail by explaining the following preferred embodiment of the present invention. However, the present invention is not limited to the following example but can be realized into various embodiments in the scope of the accompanying claims. The following example is provided to complete the disclosure of the present invention and to make those skilled in the art readily practice the present invention.

EXAMPLE

Figure 7:
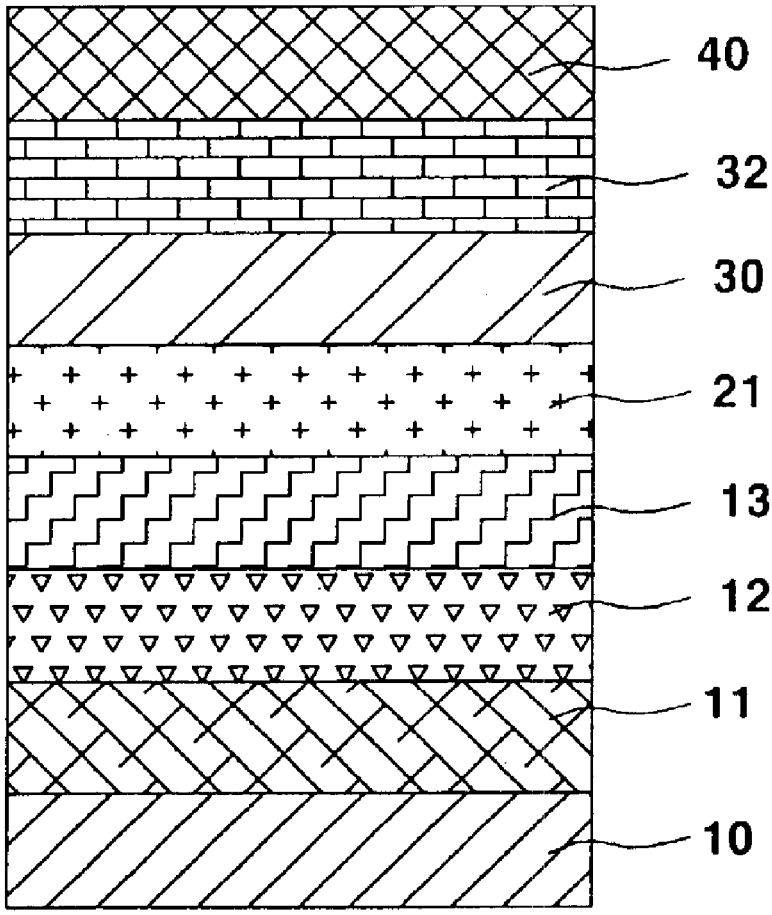
FIG. 7 is a schematic sectional view showing the layer structure of Example according to the present invention shown in the detailed description of the preferred embodiment.

FIG. 7 is a schematic sectional view showing the layer structure of this Example. The transfer paper is prepared by applying a release agent comprising 16% by weight of an acryl resin, 1% by weight of a polyester resin, 45% by weight of methylethyl ketone and 38% by weight of toluene on a PET-mat base film 10 having a thickness of about 25 $\mu$m to form a release layer 11.

On the release layer 11, an ink composition comprising 13% by weight of an acryl resin, 5% by weight of a vinyl resin, 40% by weight of methylethyl ketone, 30% by weight of toluene, 7% by weight of ethyl acetate and 5% by weight of a pigment is applied to form an ink layer 12.

On the ink layer 12, a transparent color ink composition comprising 20% by weight of nitro cellulose resin, 40% by weight of methylethyl ketone, 20% by weight of toluene, 10% by weight of ethyl acetate, 5% by weight of a dye and 5% by weight of a TDI curing agent is applied to form a transparent ink layer 13. Then, aluminum is deposited on the transparent ink layer 13 to form an aluminum deposition layer 21.

On the aluminum deposition layer 21, a composition of 25% by weight of an emulsion resin, 25% by weight of a water-soluble polybutyral rein, 10% by weight of water, 20% by weight of methanol, 16% by weight of ethanol and 4% by weight of sodium hydroxide is applied to form a dissolving function layer 30.

On the dissolving function layer 30, an ink composition comprising 13% by weight of an acryl resin, 5% by weight of a vinyl resin, 40% by weight of methylethyl ketone, 30% by weight of toluene, 7% by weight of ethyl acetate and 5% by weight of a pigment is applied to form a print ink layer 32.

On the print ink layer 32, an adhesive comprising 28% by weight of an acryl resin, 5% by weight of a vinyl resin, 35% by weight of methylethyl ketone, 25% by weight of toluene and 7% by weight of ethyl acetate is applied to form an adhesive layer 40.

The thus obtained transfer paper is transferred on a transfer object by pressing the transfer paper against the transfer object at a temperature of about 130° C. and a roller rate of about 5 m/min to produce an article by the thermal transfer paper capable of partially dissolving a metal layer.

As described above, The thermal transfer paper according to the present invention is provided with a dissolving function layer 30 able to dissolve a part of a metal layer 20, preferably an aluminum deposition layer 21, to form a dissolved part according to a desired design or pattern. Therefore, it is possible to give a unique color and texture, unlike a metal layer pattern conventionally formed by oxidation of a part of the metal layer. Specially, when a different color is transferred on the transfer object by an ink layer formed on the transfer paper, it is harmonized with a background color of the transfer object to partially show a metal-like effect. Thus, according to the present invention, a design with superior texture and color can be readily formed in various patterns, thereby accomplishing a speedy, simple and hence efficient production process and cost saving effect.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A thermal transfer paper capable of partially dissolving a metal layer comprising:

a base film;

a metal layer disposed on the base film;

a dissolving function layer partially disposed according to a desired pattern on the metal layer and formed of a resin comprising at least one selected from the group consisting of emulsion resins, water-soluble acryl resins, water soluble polybutyral resins, alcohol-soluble polybutyral resins, water soluble vinyl resins and alcohol-soluble vinyl resins, water or an alcohol solvent, and sodium hydroxide or an acid; and an adhesive late disposed on the deposited dissolving function layer and the metal layer, laminated in this order.

2. The thermal transfer paper according to claim 1, wherein the metal layer is an aluminum deposition layer.

3. The thermal transfer paper according to claim 2, wherein the thermal transfer paper comprises:

a transparent color ink layer formed of at least one resin selected from the group consisting of dap resins, nitro cellulose resins, acryl resins, acryl urethane resins, nitro cellulose resins and vinyl resin a dye;

a curing agent; and at least one solvent selected from the group consisting of ketone solvents, acetate solvents, aromatic solvents and alcohols, under the aluminum deposition layer.

4. The thermal transfer paper according to claim 1, wherein the base film is formed of at least one selected from the group consisting of transparent or amt polyester films, polypropylene films and polyvinyl chloride films and optionally a matifying agent.

5. The thermal transfer paper according to claim 1, wherein the paper further comprises, between the base film and the metal layer:

a release layer; or an ink layer; or a transparent ink layer formed of at least one resin selected from the group consisting of dap resins, nitro cellulose resins, acryl resins, acryl urethane resins, nitro cellulose resin and vinyl resins, a dye, a curing agent, and at least one solvent selected from the group consisting of ketone solvents, acetate solvents, aromatic solvents and alcohols.

6. The thermal transfer paper according to claim 5, wherein the release layer is formed of an acryl resin, and at least one solvent selected from the group consisting of ketone solvents, acetate solvents and aromatic solvents.

7. The thermal transfer according to claim 5, wherein the release layer is formed of a vinyl resin and a water-or alcohol-soluble butyral resin, water, an alcohol solvent, a ketone solvent, an acetate solvent, an aromatic solvent, a pigment, and an additive.

8. The thermal transfer paper according to claim 5, wherein the release layer is formed of an emulsion resin or water-soluble acryl, or a mixture of thereof, water, an alcohol solvent, a pigment and an additive.

9. The thermal transfer paper according to claim 5, wherein the ink layer is formed of a resin comprising at least one selected from the group consisting of acryl resins, vinyl resins, nitro cellulose resins, polyamide resins and polybutyral resins; a pigment; at least one selected from the group consisting of a dispersant, anti-precipitation agent and anti-static agent.

10. The thermal transfer paper accordingly to claim 9, the ink layer further comprises at least one additive selective from the group consisting of a dispersant, anti-precipitation agent and anti-static agent.

11. The thermal transfer paper according to any one of claims 5 to 10, wherein the paper further comprises, between the release layer and the metal layer:

an ink layer; or a transparent ink layer; or a transparent ink layer disposed on an ink layer.

12. The thermal transfer paper according to claim 3 or 5, wherein the transparent color ink layer further comprises a pearl pigment, a matifying agent and an organic pigment.

13. The thermal transfer paper according to claim 1, wherein the paper further comprises a print ink layer between the dissolving function layer and the adhesive layer.

14. The thermal transfer paper according to claim 13, wherein the print ink layer is formed of a resin comprising at least one selected from the group consisting of acryl resins, vinyl resins, nitro cellulose resins, polyamide resins and polybutyral resins; a pigment; at least one selected from the group consisting of ketone solvents, acetate solvents, aromatic solvents, water and alcohols.

15. The thermal transfer paper according to claim 14, the ink layer further comprises at least one additive selected from the group consisting of a dispersant, anti-precipitation agent and anti-static agent.

16. The thermal transfer paper according to any one of claim 13 to 15, wherein the paper further comprises, between the dissolving function layer and the print ink, a primer layer formed of methylmethacrylate resin or vinyl resin and at least one solvent selected from the group consisting of ketone solvents, acetate solvents and aromatic solvents.

17. The thermal transfer paper according to claim 16, wherein the primer layer further comprises a maleic acid resin.

18. A method for producing a thermal transfer paper comprising the steps of:

(S1) depositing a metal layer of a base film or a deposited layer formed on the base film;

(S2) dissolving a resin comprising at least one selected from the group consisting of emulsion resins, water-soluble acryl resins, water-soluble polybutyral resins, alcohol-soluble polybutyral resins, water-soluble vinyl resins and alcohol-soluble vinyl resins in water or an alcohol solvent, adding sodium hydroxide or an acid and applying the resulting solution partially on the deposited metal layer according to a desired pattern to form a dissolving function layer; and (S3) depositing an adhesive layer on the deposited dissolving function layer and the metal layer.

19. The method according to claim 18, wherein the step (S1) further comprises the steps of:

(S1-1) applying a release agent on the base film to form a release layer; or (S1-2) applying an ink on the base film or the release layer to form an ink layer; or (S1-3) applying a transparent ink comprising at least one resin selected from the group consisting of dap resins, nitro cellulose resins, acryl resins, acryl urethane resins, nitro cellulose resins, and vinyl resins; a dye; a curing agent; and at least one solvent selected from the group consisting of ketone solvents, acetate solvents, aromatics solvents and alcohols, on the base film, the release layer, or the ink layer to form a transparent ink layer.

20. The method according to claim 18, wherein the step (S2) further comprises the step (S2-1) of applying an ink on the metal layer partially deposited the dissolving function layer to form a print ink layer.

21. The method according to claim 20, the step (S2) further comprises the step (S2) of applying a primer comprising methylmethacrylate resin or vinyl resin and at least one solvent selected from the group consisting of ketone solvents, acetate solvents and aromatic solvents to form a primer layer.

* * * * *